United States Patent [19]

Pontbriand

[11] Patent Number: 4,839,931

[45] Date of Patent: Jun. 20, 1989

[54] COUNTER TOP WASTE DISPOSAL UNIT

[76] Inventor: James A. Pontbriand, P.O. Box 550, Cardinal, Ontario, K0E 1E0, Canada

[21] Appl. No.: 83,172

[22] Filed: Aug. 10, 1987

[30] Foreign Application Priority Data

Jun. 9, 1987 [CA] Canada ..... 539245

[51] Int. Cl.[4] ..... E03C 1/00

[52] U.S. Cl. ..... 4/629; 4/654

[58] Field of Search ..... 4/629, 655; 248/95, 248/97, 99; 312/140.4; 220/408, 409

[56] References Cited

U.S. PATENT DOCUMENTS

| | | | |
|---|---|---|---|
| 1,016,556 | 2/1912 | Döring | 220/409 X |
| 1,654,742 | 1/1928 | McCarthy | 4/629 |
| 1,935,382 | 11/1933 | Asselstine | 248/95 X |
| 3,402,848 | 9/1968 | Busey | 248/97 X |
| 3,893,615 | 7/1975 | Johnson | 248/95 X |
| 4,689,840 | 9/1987 | Mück et al. | 4/629 |

*Primary Examiner*—Henry J. Recla

*Attorney, Agent, or Firm*—Jones, Tullar & Cooper

[57] ABSTRACT

A receptacle for waste disposal adapted to be recessed into a counter-top. An outer rectangular container has a flange resting on the counter-top. A removable inner container is supported in the outer container and is adapted to contain a plastic bag folded over its top edge. Two of the top edges of the inner container are formed with curving flanges to act as handles for its removal. A lid lies flush with the flange of the outer container.

1 Claim, 2 Drawing Sheets

COUNTER TOP WASTE DISPOSAL UNIT

This invention relates generally to waste disposal receptacles and, more particularly, to a kitchen waste receptacle that is recessed into a counter-top.

BACKGROUND OF THE INVENTION

Kitchen waste is generally placed in a free-standing waste receptacle or in a unit located in the cupboard under the sink. In both cases, waste must be removed from the counter-tops or the sink and carried to the waste receptacle. The waste material is often wet or sticky, and spills frequently occur leaving a mess on the kitchen floor.

In order to avoid spills during the transfer of waste to the disposal unit, the present invention considers the use of a small waste receptacle which is recessed in the kitchen counter near to the sink. Waste can then be disposed of readily without spillage onto the floor. The recessed receptacle opening is almost flush with the counter surface so crumbs and waste on the counter-top may be wiped directly into the receptacle. The receptacle has a removable inner container which is lined with a plastic bag for easy and sanitary removal of the waste for disposal. A lid is provided to cover the receptacle to prevent odors from escaping. The lid lies almost flush with the counter-top in order to maintain the continuous appearance of the counter.

SUMMARY OF THE INVENTION

Specifically, the invention consists of a receptacle for waste disposal which can be recessed into a counter-top. The receptacle consists of an outer rectangular container having an open top with a flange extending outwardly and upwardly in a step-like manner and then outwardly again. The upper flange rests on the counter-top. It is made of thicker material than the rest of the container. A clamping mechanism is attached to the walls of this container which clamps the container to the counter-top. A removable inner container rests in the outer container. It has two small outward flanges at the top which lie on the long portions of the step of the outer container and two outward flanges that curve upward to form handles. Resting within the inner container is a disposable plastic bag. The top portion of the bag folds over the edge of the inner container providing enough excess material for closure of the bag for disposal. The receptacle is closed by a rectangular lid which rests on the handles of the inner container and lies flush with the upper flange and counter-top. The lid has a central indentation with a handle standing up along the length of it. Both the outer and inner containers as well as the lid are constructed of stainless steel to allow for easy maintenance and sanitary conditions.

BRIEF DESCRIPTION OF THE DRAWINGS

A specific embodiment of the invention is now described in detail with reference to the accompanying drawings, in which.

Similar reference numbers are used to indicate corresponding parts on all figures. Also, the dimensions of certain parts as shown in the drawings may have been modified or exaggerated for the purpose of clarity of illustration.

DESCRIPTION OF THE PREFERRED EMBODIMENT

Figure 1:
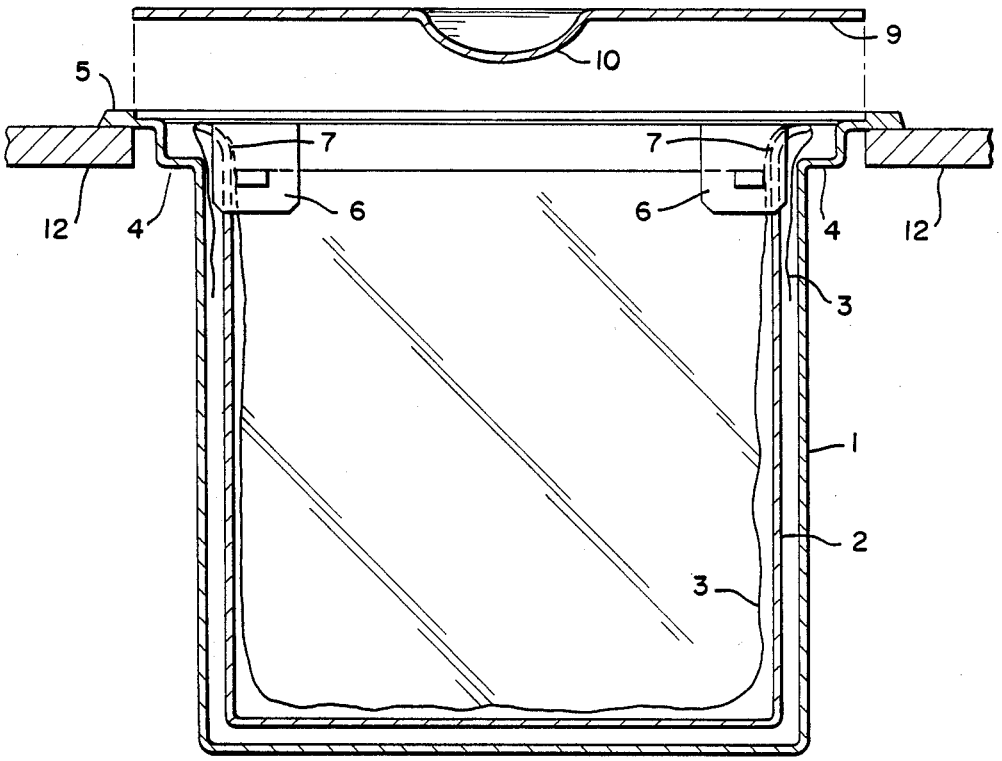
FIG. 1 is a longitudinal section through the wide portion of the waste receptacle.
Figure 2:
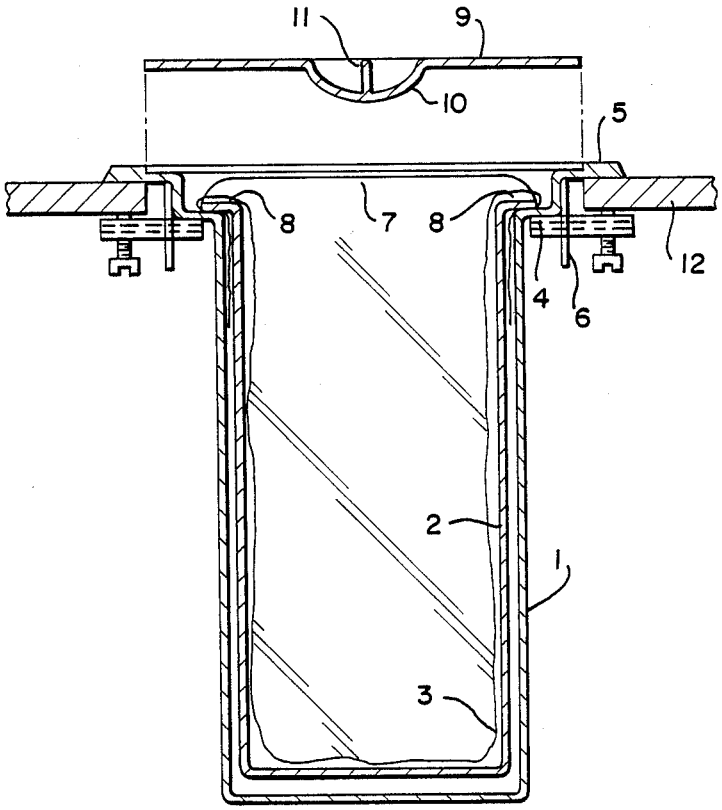
FIG. 2 is a longitudinal section through the narrow portion of the unit.

FIGS. 1 and 2 show an outer container 1 supported onto counter 12 by outward flange 5 and clamping mechanism 6. Flange 5 is made of somewhat thicker material than the rest of container 1. Within container 1 rests an inner container 2. As can be seen in FIG. 2, container 2 has outward flanges 8 which support the container on step 4 along the long sides of container 1. Handles 7, best seen in FIG. 1, are formed by flanges on container 2 that curve upwardly and are used to facilitate removal and replacement of the inner container 2. A plastic bag liner 3 rests in container 2 and folds over top of handles 7 and flanges 8 ending between containers 1 and 2. This allows the bag to remain open and easily accessible when filling and provides excess material for gathering and closing the bag for disposal. Lid 9 rests in a small step formed in flange 5, just above the level of handles 7 and lies flush with the top of flange 5. The lid can be lifted using handle 11 which stands up from the centre of indentation 10. The indentation provides room to grasp the handle for removal and replacement. When in position, the lid provides a useful surface to receive hot pans and dishes.

Figure 3:
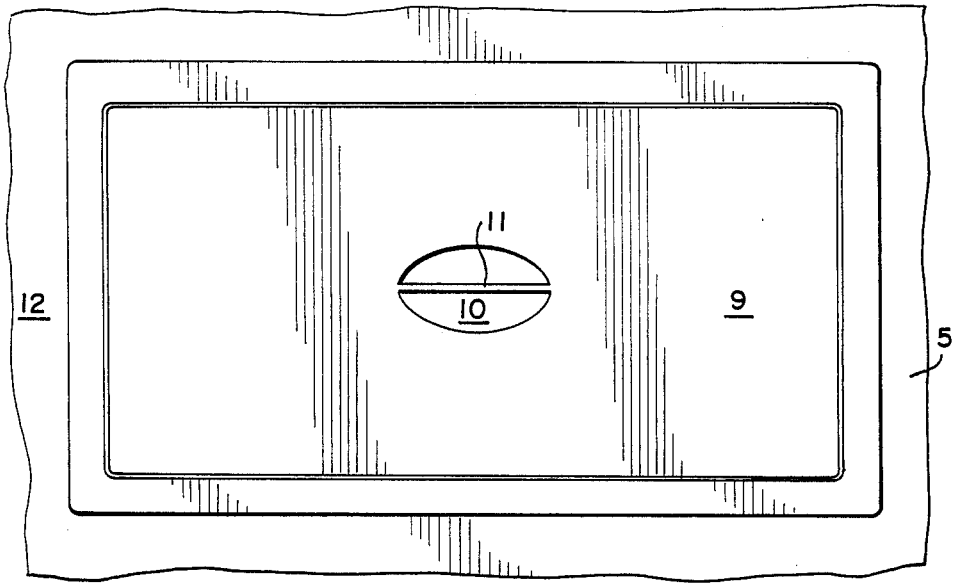
FIG. 3 is a top plan view of the unit.

FIG. 3 shows the invention as it appears in place in the counter-top. It is desirable, for both ease of cleaning and appearance, that the lid 9 and flange 5 are nearly level with the top of counter 12.

Clearly, some variations can be made to the unit as described without departing from the scope of the invention, and it is intended that such variations are covered by the appended claims.

I claim:

1. A receptacle for waste disposal which is adapted to be recessed in a counter-top, comprising:

an outer, rectangular, one-piece container, said outer container having a bottom, two long sides and two short sides defining a sealed shell with an open top and an upper edge shaped to form a lower outwardly directed flange portion, a small vertical step portion formed on the outer peripheral edge of said flange portion, and an upper outwardly directed flange portion formed at the top of said step portion and extending around the open top of the outer container, forming a flat, horizontal rim, said upper flange portion for resting on a counter top in substantially the same plane as the counter-top to support the receptacle;

an inner container nested in and supported by said outer container, said inner container having a bottom, two long sides and two short sides defining a sealed shell with an open top and an upper edge portion having a horizontal outwardly directed flange along each of said long sides and an upwardly and outwardly curved flange along each of said short sides, said flanges along said long sides of said inner container adapted to rest on and be supported by said lower flange portions of said long sides of said outer container, whereby waste material can be placed into the container or swept into the container across each long side, said short side flanges forming handles having upper edges having a height slightly less than said vertical step portion of said outer container, whereby said inner container is supported in and is removable through the open top of, said outer container; and a clamping mechanism attached to the walls of the outer container to clamp and secure said outer container to a counter-top.

* * * * *